US011008701B1

(12) United States Patent
Chang et al.

(10) Patent No.: US 11,008,701 B1
(45) Date of Patent: May 18, 2021

(54) DYEING METHOD USING BIO-DYE AND CATIONIC MODIFICATION AGENT UTILIZED THEREOF

(71) Applicant: Industrial Technology Research Institute, Hsinchu (TW)

(72) Inventors: Chang-Jung Chang, Taoyuan (TW); Pei-Ching Chang, Hsinchu County (TW); Ya-Lin Lin, Hsinchu (TW); Yu-Ju Lin, Hsinchu County (TW); Jie-Len Huang, Hsinchu (TW); Jhong-De Lin, Kaohsiung (TW); Hsiang-Yuan Chu, New Taipei (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 16/731,053

(22) Filed: Dec. 31, 2019

(51) Int. Cl.

| | |
|---|---|
| ***D06P 5/00*** | (2006.01) |
| ***D06P 5/22*** | (2006.01) |
| ***D06P 3/60*** | (2006.01) |
| *D06P 1/34* | (2006.01) |

(52) U.S. Cl.
CPC ..... *D06P 5/22* (2013.01); *D06P 3/60* (2013.01); *D06P 3/6033* (2013.01); *D06P 1/34* (2013.01)

(58) Field of Classification Search
CPC .. D06P 5/22; D06P 3/6033; D06P 3/54; D06P 1/34; D06P 3/004
USPC ..... 8/115.51
See application file for complete search history.

(56) References Cited

U.S. PATENT DOCUMENTS

| | | | |
|---|---|---|---|
| 4,629,470 | A | 12/1986 | Harper, Jr. |
| 5,131,913 | A | 7/1992 | Martini |
| 5,403,362 | A | 4/1995 | Gurley |
| 5,509,941 | A | 4/1996 | Gurley |
| 5,651,795 | A | 7/1997 | Gurley |

(Continued)

FOREIGN PATENT DOCUMENTS

| | | |
|---|---|---|
| CN | 101187175 | 5/2008 |
| CN | 108951232 | 12/2018 |

(Continued)

OTHER PUBLICATIONS

STIC Search Report dated Nov. 27, 2020.*

(Continued)

*Primary Examiner* — Eisa B Elhilo
(74) *Attorney, Agent, or Firm* — JCIPRNET

(57) ABSTRACT

The disclosure provides a dyeing method using bio-dye. A first compound containing an X group is reacted with a second compound containing a Y group to form a third compound, in which the X group is selected from the group consisting of an isocyanate group, a carbodiimide group, an aziridinyl group and an epoxy group, the Y group is selected from the group consisting of a hydroxyl group and an amine group, and the second compound is an amine compound and contains two or more Y groups. Cationization of the third compound is carried out with a fourth compound containing a carboxyl group to form a cationic modification agent. A cationic modification treatment is performed on a fiber material by using the cationic modification agent to form a cationized fiber material. Thereafter, a dyeing treatment is performed on the cationized fiber material through a dye solution containing bio-dye to color the cationized fiber material.

18 Claims, 1 Drawing Sheet

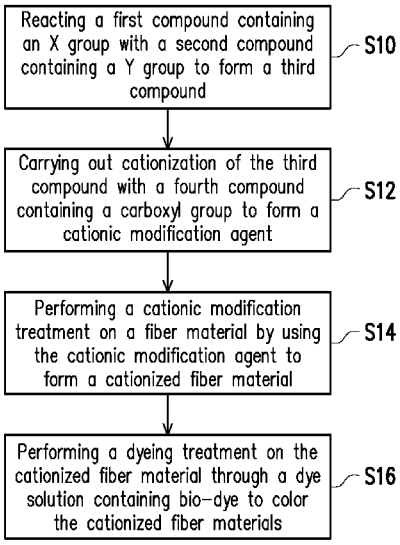

(56) References Cited

U.S. PATENT DOCUMENTS

| | | | | |
|---|---|---|---|---|
| 7,485,158 | B2 | 2/2009 | Baid | |
| 7,919,166 | B2 | 4/2011 | Becker | |
| 8,088,181 | B2 | 1/2012 | Park | |
| 8,697,429 | B2 | 4/2014 | Sachdev | |
| 8,969,441 | B2 | 3/2015 | Yano et al. | |
| 9,091,021 | B2 | 7/2015 | Heller | |
| 9,340,674 | B2 | 5/2016 | Domingo et al. | |
| 9,803,315 | B2 | 10/2017 | Kobayashi et al. | |
| 2005/0005373 | A1 | 1/2005 | Buchel | |
| 2005/0199152 | A1* | 9/2005 | Hale | D06P 1/0004 101/491 |
| 2005/0241073 | A1 | 11/2005 | Smith et al. | |
| 2007/0180627 | A1* | 8/2007 | Becker | C11D 17/041 8/115.51 |
| 2008/0271865 | A1 | 11/2008 | Soane et al. | |
| 2010/0073408 | A1* | 3/2010 | Hale | B41M 7/00 347/5 |

FOREIGN PATENT DOCUMENTS

| | | |
|---|---|---|
| TW | 200400230 | 1/2004 |
| TW | 200604407 | 2/2006 |

OTHER PUBLICATIONS

Rattanaphol Mongkholrattanasit et al., "Dyeing of Nylon Fabric with Natural Dye from Cassia Fistula Fruit: A Research on Effect Metal Mordants Concentration." Materials Science Forum, vol. 857, May 20, 2016, pp. 487-490.

N.A. Ibrahim et al., "A new approach for natural dyeing and functional finishing of cotton cellulose." Carbohydrate Polymers, vol. 82, Issue 4, Nov. 11, 2010, pp. 1205-1211.

Sudhir Kumbhar et al., "Eco-friendly dyeing of cotton with brown natural dye extracted from *Ficus amplissima* Smith leaves." Environmental Chemistry Letters, vol. 17, Issue 2, Jan. 2019, pp. 1161-1166.

Padma S. Vankar et al., "Enzymatic natural dyeing of cotton and silk fabrics without metal mordants." Journal of Cleaner Production, vol. 15, Issue 15, Oct. 2007, pp. 1441-1450.

Agrawal Bipin J., "Influence of mordant application on the dyeing of nylon substrate with natural dyes extracted from flowers." International Research Journal of Chemistry and Chemical Sciences, vol. 4, Issue 1, Sep. 2017, pp. 67-74.

M.M. Kamel et al., "Ultrasonic dyeing of cationized cotton fabric with natural dye. Part 2: Cationization of cotton using Quat 188." Industrial Crops and Products, vol. 34, Issue 3, Nov. 2011, pp. 1410-1417.

Shahnaz Parveen Khattak et al., "Optimization of fastness and tensile properties of cotton fabric dyed with natural extracts of Marigold flower (*Tagetes erecta*) by pad-steam method." Life Science Journal, vol. 11, Issue 7, Jan. 2014, pp. 52-60.

Siyamak Safapour et al., "Chitosan-cyanuric chloride hybrid as an efficient novel bio-mordant for improvement of cochineal natural dye absorption on wool yarns." The Journal of the Textile Institute, vol. 110, Issue 1, Dec. 7, 2018, pp. 1-9.

Mohammad Mirjalili et al., "Eco-friendly dyeing of wool using natural dye from weld as co-partner with synthetic dye." Journal of Cleaner Production, vol. 19, Issues 9-10, Jun.-Jul. 2011, pp. 1045-1051.

Shristi Purwar, "Application of natural dye on synthetic fabrics: A review." International Journal of Home Science, vol. 2, Issue 2, 2016, pp. 283-287.

Mohammad Raza Miah et al., "Eco-dyeing of Nylon Fabric Using Natural Dyes Extracted from Onion Outer Shells: Assessment of the Effect of Different Mordant on Color and Fastness Properties." International Journal of Scientific & Engineering Research, vol. 7, Issue 9, Sep. 2016, pp. 1030-1043.

"Notice of Allowance of Taiwan Counterpart Application," dated Apr. 28, 2020, p. 1-p. 3.

* cited by examiner

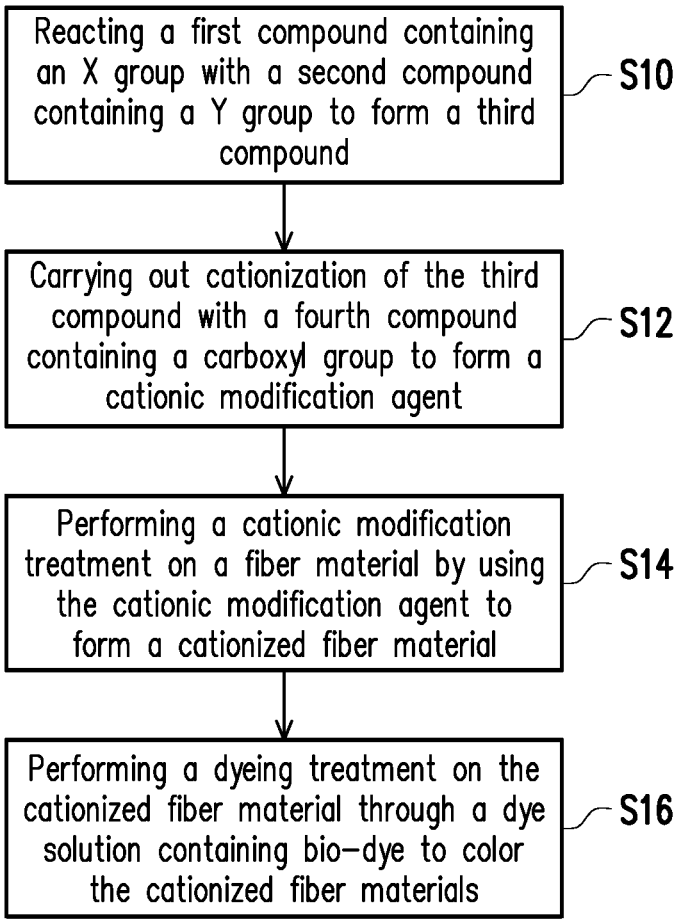
Reacting a first compound containing an X group with a second compound containing a Y group to form a third compound
S10
Carrying out cationization of the third compound with a fourth compound containing a carboxyl group to form a cationic modification agent
S12
Performing a cationic modification treatment on a fiber material by using the cationic modification agent to form a cationized fiber material
S14
Performing a dyeing treatment on the cationized fiber material through a dye solution containing bio-dye to color the cationized fiber materials
S16

DYEING METHOD USING BIO-DYE AND CATIONIC MODIFICATION AGENT UTILIZED THEREOF

TECHNICAL FIELD

The disclosure relates to a dyeing method using bio-dye and a cationic modification agent.

BACKGROUND

Toxic substances such as formaldehyde, hydrogen cyanide and other pollutants are prone to being generated in the production process of chemical synthetic dye. Although pollution problems are prone to being caused in the production process of the chemical synthetic dye, bio-dye is less selected as a dye source currently in the textile industry due to the fact that problems of insufficient degree of dyeing, difficult industrialization caused by incapability of commercialized specifications and the like exist because of insufficient binding strength of the bio-dye and fibers.

In recent years, methods for improving the affinity of the bio-dye and the natural fibers have been proposed, such as a method for improving charge repellence of dye and fibers by adding salt mordants, metal salt mordants and the like, but the methods may still produce insoluble metal complex compounds, salt sludge and other pollutants.

Therefore, how to increase the degree of dyeing by improving the affinity of the bio-dye and the natural fibers is still a to-be-achieved target in the field at present.

SUMMARY

The disclosure provides a dyeing method using bio-dye, and the method enhances the affinity of the bio-dye to natural fibers, improves the strength of colorization and improves the availability and commercial value of the bio-dye.

The disclosure provides a cationic modification agent, which can modify the surfaces of the natural fibers and be bonded to the bio-dye, so as to enhance the affinity of the bio-dye to the natural fibers.

The dyeing method using the bio-dye of the disclosure includes the following steps: reacting a first compound containing an X group with a second compound containing a Y group to form a third compound, in which the X group is selected from the group consisting of an isocyanate group, a carbodiimide group, an aziridinyl group and an epoxy group, the second compound is an amine compound, the Y group is selected from the group consisting of a hydroxyl group and an amine group, and the number of the Y group in the second compound is two or more; carrying out cationization of the third compound with a fourth compound containing a carboxyl group to form a cationic modification agent; performing a cationic modification treatment on a fiber material by using the cationic modification agent to form a cationized fiber material; and performing a dyeing treatment on the cationized fiber material through a dye solution containing bio-dye to color the cationized fiber material.

The cationic modification agent of the disclosure includes an amine salt containing a bivalent linking group and a Y group, and the bivalent linking group is selected from one of a formula (I) to a formula (IV) in the following:

Formula (I)

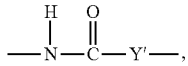

Formula (II)

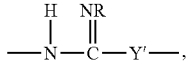

Formula (III)

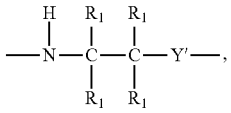

Formula (IV)

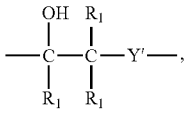

the Y group is located at one of terminals of the amine salt, and the Y group is selected from the group consisting of a hydroxyl group and an amine group, in the formula (I) to the formula (IV), each Y' is independently —NH— or —O—, in the formula (II), R is a hydrogen atom or an organic functional group with a carbon number of 1-12, and in the formula (III) and the formula (IV), each $R_1$ is independently a hydrogen atom or an organic functional group with a carbon number of 1-12.

Based on the above, before the dye solution containing the bio-dye is utilized to perform the dyeing treatment, the dyeing method using the bio-dye of the disclosure includes the following steps: reacting the first compound containing the X group with the second compound containing the Y group to form the third compound, in which the X group is selected from the group consisting of the isocyanate group, the carbodiimide group, the aziridinyl group and the epoxy group, the Y group is selected from the group consisting of the hydroxyl group and the amine group, the second compound is the amine compound, and the number of the Y group in the second compound is two or more; carrying out cationization of the third compound with the fourth compound containing the carboxyl group to form the cationic modification agent; and performing the cationic modification treatment on the fiber material by using the cationic modification agent. Therefore, without using salt mordants or metal mordants, the dyeing method using the bio-dye of the disclosure still can enhance the affinity of the bio-dye to the fiber material and improve the strength of colorization.

Embodiments are provided below and described in detail with reference to the drawings to make the above features and advantages of the disclosure more obvious and understandable.

BRIEF DESCRIPTION OF THE DRAWINGS

FIG. 1 is a flowchart of a dyeing method using bio-dye according to an embodiment of the disclosure.

DETAILED DESCRIPTION OF DISCLOSED EMBODIMENTS

In the disclosure, a range expressed by 'one value to another value' is a schematic expression way of avoiding one-by-one listing of all values within the range in the description. Recording of a certain value range covers any value therein and a small value range defined by any value therein, just like clearly giving any value and the small value range in the description.

'about', 'approximate', 'essentially' or 'substantially' used in the disclosure includes average values within an acceptable deviation range of the values and specific values determined by ordinary skilled in the art, and discussed measurement and the specific quantity of errors related to the measurement (namely, limitation of a measurement system) are considered. For example, 'about' may express that a value is within one or more standard deviations of values, or within ±30%, ±20%, ±15%, ±10%, ±5% and the like. Besides, through 'about', 'approximate', 'essentially' or 'substantially' used in the disclosure, a relatively acceptable deviation range or standard deviations may be selected according to measurement properties or other properties, and one standard deviation does not need to be suitable for all properties.

Expression of groups (atomic groups) adopted in the disclosure does not only cover groups without substituent groups, but also cover groups with substituent groups even if 'substituted and unsubstituted' are not mentioned. For example, an 'alkyl group' does not only cover an alkyl group without a substituent group (unsubstituted alkyl group), but also covers an alkyl group with a substituent group (substituted alkyl group).

In order to provide a dyeing method capable of enhancing the affinity of bio-dye to a fiber material without using salt mordants or metal mordants, the disclosure provides a dyeing method using bio-dye, which can realize the above advantages. In the following, embodiments are provided to be used as examples for embodiment of the disclosure.

FIG. 1 is a flowchart of the dyeing method using the bio-dye according to one embodiment of the disclosure.

Referring to FIG. 1, first, step S10 is performed, in which a first compound containing an X group is reacted with a second compound containing a Y group to form a third compound is carried out. In the present embodiment, the X group may be selected from the group consisting of an isocyanate group, a carbodiimide group, an aziridinyl group and an epoxy group. That is, the X group may be called an active group. Specifically, the isocyanate group and the carbodiimide group both have high reaction activity by containing unsaturated bonds, and the aziridinyl group and the epoxy group both have high reaction activity due to existence of three-membered rings with high tension. In addition, in the present embodiment, the Y group may be selected from the group consisting of a hydroxyl group (—OH) and an amine group (—$NH_2$). That is, the Y group may be called a nucleophilic group. In other words, the second compound containing the Y group is a compound with active hydrogen. Further, in the present embodiment, the second compound is an amine compound, and thus the second compound containing the Y group is the amine compound containing the Y group.

In the present embodiment, since the X group has high reaction activity and the Y group has nucleophilicity, the third compound is obtained through reaction of the X group in the first compound containing the X group with the Y group in the second compound containing the Y group. In an embodiment that the X group is the isocyanate group and the Y group is the hydroxyl group, oxygen atoms of the hydroxyl group and carbon atoms of the isocyanate group undergo polyaddition polymerization to form a carbamate group (—NHCOO—). Similarly, in an embodiment that the X group is the isocyanate group and the Y group is the amine group, nitrogen atoms of the amine group and the carbon atoms of the isocyanate group undergo polyaddition polymerization to form ureylene (—NHCONH—).

In addition, in an embodiment that the X group is the carbodiimide group and the Y group is the hydroxyl group, the oxygen atoms of the hydroxyl group and the carbon atoms of the carbodiimide group undergo polyaddition polymerization. Similarly, in an embodiment that the X group is the carbodiimide group and the Y group is the amine group, the nitrogen atoms of the amine group and the carbon atoms of the carbodiimide group undergo polyaddition polymerization.

Furthermore, in an embodiment that the X group is the aziridinyl group and the Y group is the hydroxyl group, the oxygen atoms of the hydroxyl group and the carbon atoms of the aziridinyl group undergo nucleophilic addition to achieve ring-opening of the aziridinyl group. Similarly, in an embodiment that the X group is the aziridinyl group and the Y group is the amine group, the nitrogen atoms of the amine group and the carbon atoms of the aziridinyl group undergo nucleophilic addition to achieve ring-opening of the aziridinyl group.

Besides, in an embodiment that the X group is the epoxy group and the Y group is the hydroxyl group, the oxygen atoms of the hydroxyl group and carbon atoms of the epoxy group undergo nucleophilic addition to achieve ring-opening of the epoxy group. Similarly, in an embodiment that the X group is the epoxy group and the Y group is the amine group, the nitrogen atoms of the amine group and the carbon atoms of the epoxy group undergo nucleophilic addition to achieve ring-opening of the epoxy group.

Specifically, in the present embodiment, the third compound may include a bivalent linking group expressed by one of a formula (I) to a formula (IV) in the following:

Formula (I)

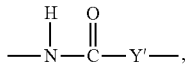

Formula (II)

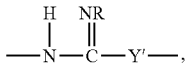

Formula (III)

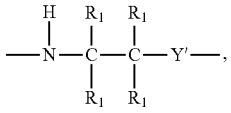

Formula (IV)

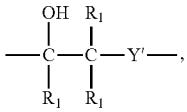

In the formula (I) to the formula (IV) above, each Y' is independently —NH— or —O—. In the formula (II), R is a hydrogen atom or an organic functional group with a carbon number of 1-12. As the organic functional group with a carbon number of 1-12, for example, alkyl groups with a carbon number of 2-8, or 3-7 or 4-6 can be listed (but not limited thereto). In the formula (III) and the formula (IV) above, each $R_1$ is independently a hydrogen atom or an organic functional group with a carbon number of 1-12. As the organic functional group with a carbon number of 1-12, for example, the alkyl groups with a carbon number of 2-8, or 3-7 or 4-6 can be listed (but not limited thereto).

In the present embodiment, the number of the X group in the first compound containing the X group is one or two or more. Specifically, examples of the first compound containing the X group may include, but not limited to isophorone diisocyanate (IPDI), 1-ethyl-3-(3-dimethylaminopropyl) carbodiimide hydrochloride, or pentaerythritol tris[3-(1-aziridinyl)propionate].

In the present embodiment, the number of the Y group in the second compound containing the Y group is two or more. Additionally, the second compound containing the Y group may be a tertiary amine compound in the present embodiment. Specifically, examples of the second compound containing the Y group may include, but not limited to: N-methyldiethanolamine.

In the present embodiment, a molar ratio of the first compound containing the X group to the second compound containing the Y group may be about 1:0.5 to about 1:1.5, for example, about 1:0.5, about 1:0.75, about 1:1, about 1:1.25 or about 1:1.5, but not limited thereto. As described above, the number of the Y group in the second compound containing the Y group is two or more, so after the first compound containing the X group is reacted with the second compound containing the Y group, the third compound will contain the Y group located at one terminal. In a similar way, in an embodiment that the first compound containing the X group contains two or more X groups, after the first compound containing the X group is reacted with the second compound containing the Y group, the third compound will contain the X group located at another terminal.

In the present embodiment, the first compound containing the X group and the second compound containing the Y group may react at a temperature of about 75° C. to about 80° C., for example, about 76° C., about 77° C., about 78° C., about 79° C. or about 80° C., but not limited thereto. In the present embodiment, the first compound containing the X group and the second compound containing the Y group may react for about 2 hours to about 3 hours, for example, about 2 hours, about 2.5 hours or about 3 hours, but not limited thereto.

Next, Step S12 is performed, in which cationization of the third compound with a fourth compound containing a carboxyl group is carried out to form a cationic modification agent is then carried out. In the present embodiment, the cationization is performed by protonating the third compound through protons provided by the fourth compound containing the carboxyl group. As described above, the third compound is obtained by reacting the X group in the first compound containing the X group with the Y group in the second compound containing the Y group, and may contain the bivalent linking group expressed by one of the formula (I) to the formula (IV) above, so the cationic modification agent formed by protonation of the third compound may include an amine salt of the bivalent linking group expressed by one of the formula (I) to the formula (IV) above. In the present embodiment, protonation occurs on a tertiary nitrogen atom, derived from a structure part of the second compound containing the Y group, of the third compound. Additionally, as described above, the third compound contains the Y group located at the terminal, so that the amine salt formed by protonation of the third compound may include the Y group located at the terminal. Besides, as described above, the third compound may contain the X group located at the terminal, so that the amine salt may further contain the X group located at the terminal. That is, in the present embodiment, the cationic modification agent has reactivity.

In the present embodiment, the fourth compound containing the carboxyl group may be a monomer acid. Specifically speaking, examples of the fourth compound containing the carboxyl group may include, but not limited to: acetic acid, lactic acid, acrylic acid or glycolic acid. In the present embodiment, a mole number of the fourth compound containing the carboxyl group for the cationization may be substantially close to or the same with a mole number of the second compound containing the Y group for forming the third compound. In other words, a molar ratio of the second compound containing the Y group to the fourth compound containing the carboxyl group may be about 1:0.8 to about 1:1.2, for example, about 1:0.8, about 1:0.85, about 1:0.9, about 1:1, about 1:1.1 or about 1:1.2, but not limited thereto.

In the present embodiment, during the cationization, a reaction temperature may be about 50° C. to about 55° C., for example, about 51° C., about 52° C., about 53° C., about 54° C. or about 55° C., but not limited thereto; and reaction time may be about 1 hour to about 2 hours, for example, about 1 hour, about 1.5 hours or about 2 hours, but not limited thereto.

Then, Step S14 is performed, in which a cationic modification treatment is performed on a fiber material by using the cationic modification agent to form a cationized fiber material is then carried out. In the present embodiment, the cationic modification treatment is performed through bonding of the cationic modification agent and the fiber material, that is, a cationic structure is introduced into the fiber material through a bonding effect between the cationic modification agent and the surface of the fiber material so as to form the cationized fiber material.

In the present embodiment, the fiber material may include natural fibers, yarns formed by the natural fibers, or textile fabric or non-textile fabric prepared from the natural fibers. The natural fibers may include animal fibers, plant fibers or combinations thereof. The animal fibers may include, but not limited to: wool, silk, horsehair or combinations thereof. The plant fibers may include, but not limited to: cellulose, cotton, linen, rayon or combinations thereof. In one embodiment, as described above, the amine salt contains the X group (namely an active group) located at the terminal so that the cationic modification agent can be bonded to the fiber material through reaction of the X group (namely the active group) and groups (such as amine groups on surfaces of the animal fibers and hydroxyl groups on surfaces of the plant fibers) on the surface of the fiber material, and thus the cationized fiber material is formed.

In the present embodiment, during the cationic modification treatment, the cationic modification agent may be prepared into a solution with a concentration being about 2% owf to about 8% owf (on weight of the fabric), and a solvent is water or the like. In addition, the cationic modification agent may further be prepared into a solution with a concentration being about 2.5% owf to about 7.5% owf, or about 3% owf to about 7% owf, or about 3.5% owf to about 6.5% owf or about 4% owf to about 6% owf, but not limited thereto. In the present embodiment, a liquor ratio of the solution of the cationic modification agent to the fiber material may be about 1:5 to about 1:20, for example, about 1:5 to about 1:10, about 1:10 to about 1:15, or about 1:15 to about 1:20, but not limited thereto.

In the present embodiment, a reaction temperature of the cationic modification treatment may be ranging from about 50° C. to about 60° C., for example, about 50° C. to about 55° C., about 52° C. to about 56° C., about 53° C. to about 58° C., about 55° C. to about 59° C., about 52° C., about 55° C. or about 58° C., but not limited thereto; reaction time of the cationic modification treatment may be about 0.2 hour to about 2 hours, for example, about 0.5 hour to about 2 hours, about 0.5 hour to about 1.5 hours, about 1.2 hours to about 2 hours, about 0.5 hour, about 1 hour, about 1.5 hours or about 2 hours, but not limited thereto; and during the cationic modification treatment, a pH value may be about 12 to about 13, for example, about 12, about 12.5 or about 13, but not limited thereto.

In addition, in the present embodiment, before the cationic modification treatment is performed on the fiber material by using the cationic modification agent, the fiber material may be subjected to scouring treatment to remove impurities not belonging to fibers and oil stains.

Afterwards, Step S16 is performed, in which a dyeing treatment is performed on the cationized fiber material through a dye solution containing bio-dye to color the cationized fiber material is then carried out. In the present embodiment, the dyeing treatment is performed through bonding between the bio-dye in the dye solution containing the bio-dye and the cationized fiber material. As described above, the amine salt contains the Y group (namely a nucleophilic group containing active hydrogen) located at the terminal, so the cationized fiber material is colored through hydrogen-bond interaction between the bio-dye in the dye solution containing the bio-dye and the Y group (namely the nucleophilic group containing active hydrogen) of the cationized fiber material, that is, before the dyeing treatment, the fiber material is modified by using the cationic modification agent to enhance affinity of the bio-dye to the fiber material. In other words, the fiber material is dyed by the bio-dye through the bonding effect between the cationic modification agent and the fiber material as well as between the cationic modification agent and the bio-dye. Therefore, the dyeing method provided by the present embodiment can be configured to dye the natural fibers with the bio-dye but without using the salt mordants or metal mordants.

In the present embodiment, a solvent of the dye solution containing the bio-dye may be water or the like. In the present embodiment, examples of the bio-dye may include, but not limited to: carminic acid, an extract of *Tagetes erecta*, catechin, prodigiosin, melanin or combinations thereof.

In the present embodiment, a concentration of the dye solution containing the bio-dye may be about 2% owf to 8% owf, for example, about 2.5% owf to 7.5% owf, about 3% owf to 7% owf, about 3.5% owf to 6.5% owf or about 4% owf to 6% owf, but not limited thereto. A liquor ratio of the dye solution containing the bio-dye to the cationized fiber material may be about 1:5 to about 1:20, for example, about 1:5 to about 1:10, about 1:10 to about 1:15, or about 1:15 to about 1:20, but not limited thereto.

In the present embodiment, a reaction temperature of the dyeing treatment may be ranging from about 50° C. to about 80° C., for example, about 50° C. to about 55° C., about 55° C. to about 60° C., about 60° C. to about 65° C., about 65° C. to about 70° C., about 70° C. to about 75° C. or about 75° C. to about 80° C., but not limited thereto; reaction time of the dyeing treatment may be ranging from about 0.5 hour to about 2 hours, for example, about 0.5 hour, about 1 hour, about 1.5 hours or about 2 hours, but not limited thereto; and a reaction pH value of the dyeing treatment may be ranging from about 3 to about 11, for example, about 3 to about 10, about 4 to about 10, about 3 to about 9, about 4 to about 8 or about 5 to about 7, but not limited thereto.

In addition, in the present embodiment, after the dyeing treatment is performed to color the cationized fiber material, the colored cationized fiber material may be subjected to a soaping treatment to remove surplus bio-dye. In addition, in the present embodiment, no matter whether the soaping treatment is carried out or not, the colored cationized fiber material is subjected to a drying treatment to facilitate later application. In the present embodiment, a drying step may be performed at the temperature of about 20° C. to about 50° C., for example, about 25° C. to about 50° C., about 25° C. to about 45° C., about 25° C. to about 40° C., about 30° C. to about 45° C., about 35° C., about 45° C., about 25° C., about 30° C., about 35° C. or about 40° C., but not limited thereto.

By performing the above steps (such as Steps S10-S16), the dyeing method using the bio-dye provided by one embodiment of the disclosure can be completed. It is worth noting that since the cationic modification agent (obtained by the cationization of the fourth compound containing the carboxyl group with the third compound generated by the reaction of the first compound containing the X group and the second compound containing the Y group) may modify the surface of the fiber material and bond to the bio-dye, the dyeing method using the bio-dye of the disclosure may enhance the affinity of the bio-dye to the natural fibers and improve the strength of colorization without using the salt mordants or metal mordants. Therefore, the dyeing method using the bio-dye of the disclosure may improve the utilizability and commercial value of the bio-dye. On the other hand, since the cationic modification agent may have the bonding effect with the fiber material and the bio-dye respectively, the dyeing method using the bio-dye of the disclosure has good selection flexibility in matching of the fiber material and the bio-dye.

The disclosure will be described more specifically by reference to Examples 1-15 and Comparative Examples 1-7 in the following. Although the following Examples are described, under the condition of not going beyond the scope of the disclosure, the adopted materials, quantity and ratios thereof, treatment details and treatment flows and the like may be properly changed. Therefore, the disclosure should not be limitedly explained according to experiments in the following.

Example 1

Preparation of Cationic Modification Agent

Firstly, isophorone diisocyanate (IPDI) and N-methyldiethanolamine with a molar ratio being 1:1 are reacted at 82° C. for 2.5 hours. Then, acetic acid with a mole number being the same as that of the adopted N-methyldiethanolamine is added, cationization is carried out at 55° C. for 1 hour, and the cationic modification agent of Example 1 is obtained.

Scouring Treatment and Modification Treatment

Firstly, 100% pure cotton textile fabric (composed of yarns with a specification of 32S/1) is placed in a liquid containing 6 g/L of 30% hydrogen peroxide, 5 g/L of 45% sodium hydroxide and 2 g/L of an anionic interfacial agent and with a liquor ratio of 1:10. Then, the 100% cotton textile fabric is scoured at 80° C. for 30 minutes and then cleaned with clear water. Afterwards, the cationic modification agent of Example 1 is added into water to form a solution with a concentration of 5% owf, and a pH value of the solution is adjusted to be about 12.2. Then, after being modified for 30 minutes under the conditions that a liquor ratio is 1:10 and a temperature is 55° C., the 100% cotton textile fabric is cleaned with clear water and dried at 50° C. to obtain a cationized fiber material of Example 1.

Dyeing Process

Firstly, prodigiosin from a microbial fermentation product is added into water to form a dye solution with a concentration of 2% owf, and a pH value of the dye solution is adjusted to be 10. Then, the cationized fiber material of Example 1 is immersed in the dye solution to be dyed for 60 minutes under the conditions that a liquor ratio is 1:10 and a temperature is 80° C., and the cationized fiber material is cleaned with clear water and dried at 50° C. to obtain a colored cationized fiber material of Example 1. Afterwards, the colored cationized fiber material of Example 1 is subjected to soaping for 10 minutes with 1 g/L of the anionic interfacial agent under the conditions that a liquor ratio is 1:10 and a temperature is 98° C., and then cleaned with clear water and dried at 50° C.

Example 2

Preparation of Cationic Modification Agent

Firstly, IPDI and N-methyldiethanolamine with a molar ratio being 1:1 are reacted at 82° C. for 2.5 hours. Then, acetic acid with a mole number being the same as that of the adopted N-methyldiethanolamine is added, cationization is carried out at 55° C. for 1 hour, and the cationic modification agent of Example 2 is obtained.

Scouring Treatment and Modification Treatment

Firstly, 100% pure cotton textile fabric (composed of yarns with a specification of 32S/1) is placed in a liquid containing 6 g/L of 30% hydrogen peroxide, 5 g/L of 45% sodium hydroxide and 2 g/L of an anionic interfacial agent and with a liquor ratio of 1:10. Then, the 100% cotton textile fabric is scoured at 80° C. for 30 minutes and then cleaned with clear water. Afterwards, the cationic modification agent of Example 2 is added into water to form a solution with a concentration of 5% owf, and a pH value of the solution is adjusted to be about 12.2. Then, after being modified for 30 minutes under the conditions that a liquor ratio is 1:10 and a temperature is 55° C., the 100% cotton textile fabric is cleaned with clear water and dried at 50° C. to obtain a cationized fiber material of Example 2.

Dyeing Process

Firstly, an extract of *Tagetes erecta* is added into water to form a dye solution with a concentration of 5% owf, and a pH value of the dye solution is adjusted to be 10. Then, the cationized fiber material of Example 2 is immersed in the dye solution to be dyed for 60 minutes under the conditions that a liquor ratio is 1:10 and a temperature is 80° C., and the cationized fiber material is cleaned with clear water and dried at 50° C. to obtain a colored cationized fiber material of Example 2. Afterwards, the colored cationized fiber material of Example 2 is subjected to soaping for 10 minutes with 1 g/L of the anionic interfacial agent under the conditions that a liquor ratio is 1:10 and a temperature is 98° C., and then cleaned with clear water and dried at 50° C.

Example 3

Preparation of Cationic Modification Agent

Firstly, IPDI and N-methyldiethanolamine with a molar ratio being 1:1 are reacted at 82° C. for 2.5 hours. Then, acetic acid with a mole number being the same as that of the used N-methyldiethanolamine is added, cationization is carried out at 55° C. for 1 hour, and the cationic modification agent of Example 3 is obtained.

Scouring Treatment and Modification Treatment

Firstly, 100% pure cotton textile fabric (composed of yarns with a specification of 32S/1) is placed in a liquid containing 6 g/L of 30% hydrogen peroxide, 5 g/L of 45% sodium hydroxide and 2 g/L of an anionic interfacial agent and with a liquor ratio of 1:10. Then, the 100% cotton textile fabric is scoured at 80° C. for 30 minutes and then cleaned with clear water. Afterwards, the cationic modification agent of Example 3 is added into water to form a solution with a concentration of 5% owf, and a pH value of the solution is adjusted to be about 12.2. Then, after being modified for 30 minutes under the conditions that a liquor ratio is 1:10 and a temperature is 55° C., the 100% cotton textile fabric is cleaned with clear water and dried at 50° C. to obtain a cationized fiber material of Example 3.

Dyeing Process

Firstly, catechin extracted from green tea is added into water to form a dye solution with a concentration of 5% owf, and a pH value of the dye solution is adjusted to be 10. Then, the cationized fiber material of Example 3 is immersed in the dye solution to be dyed for 60 minutes under the conditions that a liquor ratio is 1:10 and a temperature is 80° C., and the cationized fiber material is cleaned with clear water and dried at 50° C. to obtain a colored cationized fiber material of Example 3. Afterwards, the colored cationized fiber material of Example 3 is subjected to soaping for 10 minutes with 1 g/L of the anionic interfacial agent under the conditions that a liquor ratio is 1:10 and a temperature is 98° C., and then cleaned with clear water and dried at 50° C.

Example 4

Preparation of Cationic Modification Agent

Firstly, IPDI and N-methyldiethanolamine with a molar ratio being 1:1 are reacted at 82° C. for 2.5 hours. Then, acetic acid with a mole number being the same as that of the used N-methyldiethanolamine is added, cationization is carried out at 55° C. for 1 hour, and the cationic modification agent of Example 4 is obtained.

Scouring Treatment and Modification Treatment

Firstly, 100% pure cotton textile fabric (composed of yarns with a specification of 32S/1) is placed in a liquid containing 6 g/L of 30% hydrogen peroxide, 5 g/L of 45% sodium hydroxide and 2 g/L of an anionic interfacial agent and with a liquor ratio of 1:10. Then, the 100% cotton textile fabric is scoured at 80° C. for 30 minutes and then cleaned with clear water. Afterwards, the cationic modification agent of Example 4 is added into water to form a solution with a concentration of 5% owf, and a pH value of the solution is adjusted to be about 12.2. Then, after being modified for 30 minutes under the conditions that a liquor ratio is 1:10 and a temperature is 55° C., the 100% cotton textile fabric is cleaned with clear water and dried at 50° C. to obtain a cationized fiber material of Example 4.

Dyeing Process

Firstly, melanin extracted from cuttlefish sacs is added into water to form a dye solution with a concentration of 5% owf, and a pH value of the dye solution is adjusted to be 4. Then, the cationized fiber material of Example 4 is immersed in the dye solution to be dyed for 60 minutes under the conditions that a liquor ratio is 1:10 and a temperature is 80° C., and the cationized fiber material is cleaned with clear water and dried at 50° C. to obtain a colored cationized fiber material of Example 4. Afterwards, the colored cationized fiber material of Example 4 is subjected to soaping for 10 minutes with 1 g/L of the anionic interfacial agent under the conditions that a liquor ratio is 1:10 and a temperature is 98° C., and then cleaned with clear water and dried at 50° C.

Example 5

Preparation of Cationic Modification Agent

Firstly, IPDI and N-methyldiethanolamine with a molar ratio being 1:1 are reacted at 82° C. for 2.5 hours. Then, acetic acid with a mole number being the same as that of the used N-methyldiethanolamine is added, cationization is carried out at 55° C. for 1 hour, and the cationic modification agent of Example 5 is obtained.

Scouring Treatment and Modification Treatment

Firstly, 100% pure cotton textile fabric (composed of yarns with a specification of 32S/1) is placed in a liquid containing 6 g/L of 30% hydrogen peroxide, 5 g/L of 45% sodium hydroxide and 2 g/L of an anionic interfacial agent and with a liquor ratio of 1:10. Then, the 100% cotton textile fabric is scoured at 80° C. for 30 minutes and then cleaned with clear water. Afterwards, the cationic modification agent of Example 5 is added into water to form a solution with a concentration of 5% owf, and a pH value of the solution is adjusted to be about 12.2. Then, after being modified for 30 minutes under the conditions that a liquor ratio is 1:10 and a temperature is 55° C., the 100% cotton textile fabric is cleaned with clear water and dried at 50° C. to obtain a cationized fiber material of Example 5.

Dyeing Process

Firstly, carminic acid from a cochineal extract is added into water to form a dye solution with a concentration of 5% owf, and a pH value of the dye solution is adjusted to be 4. Then, the cationized fiber material of Example 5 is immersed in the dye solution to be dyed for 60 minutes under the conditions that a liquor ratio is 1:10 and a temperature is 80° C., and the cationized fiber material is cleaned with clear water and dried at 50° C. to obtain a colored cationized fiber material of Example 5. Afterwards, the colored cationized fiber material of Example 5 is subjected to soaping for 10 minutes with 1 g/L of the anionic interfacial agent under the conditions that a liquor ratio is 1:10 and a temperature is 98° C., and then cleaned with clear water and dried at 50° C.

Example 6

Preparation of Cationic Modification Agent

Firstly, IPDI and N-methyldiethanolamine with a molar ratio being 1:1 are reacted at 82° C. for 2.5 hours. Then, acetic acid with a mole number being the same as that of the used N-methyldiethanolamine is added, cationization is carried out at 55° C. for 1 hour, and the cationic modification agent of Example 6 is obtained.

Scouring Treatment and Modification Treatment

Firstly, 100% silk textile fabric (composed of yarns with a specification of 20S/1) is placed in a liquid containing 6 g/L of 30% hydrogen peroxide, 5 g/L of 45% sodium hydroxide and 2 g/L of an anionic interfacial agent and with a liquor ratio of 1:10. Then, the 100% silk textile fabric is scoured at 80° C. for 30 minutes and then cleaned with clear water. Afterwards, the cationic modification agent of Example 6 is added into water to form a solution with a concentration of 5% owf, and a pH value of the solution is adjusted to be about 12.2. Then, after being modified for 30 minutes under the conditions that a liquor ratio is 1:10 and a temperature is 55° C., the 100% silk textile fabric is cleaned with clear water and dried at 50° C. to obtain a cationized fiber material of Example 6.

Dyeing Process

Firstly, an extract of *Tagetes erecta* is added into water to form a dye solution with a concentration of 5% owf, and a pH value of the dye solution is adjusted to be 4. Then, the cationized fiber material of Example 6 is immersed in the dye solution to be dyed for 60 minutes under the conditions that a liquor ratio is 1:10 and a temperature is 80° C., and the cationized fiber material is cleaned with clear water and dried at 50° C. to obtain a colored cationized fiber material of Example 6. Afterwards, the colored cationized fiber material of Example 6 is subjected to soaping for 30 minutes with 2 g/L of the anionic interfacial agent under the conditions that a liquor ratio is 1:10 and a temperature is 65° C., and then cleaned with clear water and dried at 50° C.

Example 7

Preparation of Cationic Modification Agent

Firstly, IPDI and N-methyldiethanolamine with a molar ratio being 1:1 are reacted at 82° C. for 2.5 hours. Then, acetic acid with a mole number being the same as that of the used N-methyldiethanolamine is added, cationization is carried out at 55° C. for 1 hour, and the cationic modification agent of Example 7 is obtained.

Scouring Treatment and Modification Treatment

Firstly, 100% silk textile fabric (composed of yarns with a specification of 20S/1) is placed in a liquid containing 6 g/L of 30% hydrogen peroxide, 5 g/L of 45% sodium hydroxide and 2 g/L of an anionic interfacial agent and with a liquor ratio of 1:10. Then, the 100% silk textile fabric is scoured at 80° C. for 30 minutes and then cleaned with clear water. Afterwards, the cationic modification agent of Example 7 is added into water to form a solution with a concentration of 5% owf, and a pH value of the solution is adjusted to be about 12.2. Then, after being modified for 30 minutes under the conditions that a liquor ratio is 1:10 and a temperature is 55° C., the 100% silk textile fabric is cleaned with clear water and dried at 50° C. to obtain a cationized fiber material of Example 7.

Dyeing Process

Firstly, carminic acid from a cochineal extract is added into water to form a dye solution with a concentration of 5% owf, and a pH value of the dye solution is adjusted to be 4. Then, the cationized fiber material of Example 7 is immersed in the dye solution to be dyed for 60 minutes under the conditions that a liquor ratio is 1:10 and a temperature is 80° C., and the cationized fiber material is cleaned with clear water and dried at 50° C. to obtain a colored cationized fiber material of Example 7. Afterwards, the colored cationized fiber material of Example 7 is subjected to soaping for 30 minutes with 2 g/L of the anionic interfacial agent under the conditions that a liquor ratio is 1:10 and a temperature is 65° C., and then cleaned with clear water and dried at 50° C.

Example 8

Preparation of Cationic Modification Agent

Firstly, 1-ethyl-3-(3-dimethylaminopropyl) carbodiimide hydrochloride and N-methyldiethanolamine with a molar ratio being 1:1 are reacted at 82° C. for 2.5 hours. Then, acetic acid with a mole number being the same as that of the used N-methyldiethanolamine is added, cationization is carried out at 55° C. for 1 hour, and the cationic modification agent of Example 8 is obtained.

Scouring Treatment and Modification Treatment

Firstly, 100% pure cotton textile fabric (composed of yarns with a specification of 32S/1) is placed in a liquid containing 6 g/L of 30% hydrogen peroxide, 5 g/L of 45% sodium hydroxide and 2 g/L of an anionic interfacial agent and with a liquor ratio of 1:10. Then, the 100% cotton textile fabric is scoured at 80° C. for 30 minutes and then cleaned with clear water. Afterwards, the cationic modification agent of Example 8 is added into water to form a solution with a concentration of 5% owf, and a pH value of the solution is adjusted to be about 12.2. Then, after being modified for 30 minutes under the conditions that a liquor ratio is 1:10 and a temperature is 55° C., the 100% cotton textile fabric is cleaned with clear water and dried at 50° C. to obtain a cationized fiber material of Example 8.

Dyeing Process

Firstly, an extract of *Tagetes erecta* is added into water to form a dye solution with a concentration of 5% owf, and a pH value of the dye solution is adjusted to be 10. Then, the cationized fiber material of Example 8 is immersed in the dye solution to be dyed for 60 minutes under the conditions that a liquor ratio is 1:10 and a temperature is 80° C., and the cationized fiber material is cleaned with clear water and dried at 50° C. to obtain a colored cationized fiber material of Example 8. Afterwards, the colored cationized fiber material of Example 8 is subjected to soaping for 10 minutes with 1 g/L of the anionic interfacial agent under the conditions that a liquor ratio is 1:10 and a temperature is 98° C., and then cleaned with clear water and dried at 50° C.

Example 9

Preparation of Cationic Modification Agent

Firstly, 1-ethyl-3-(3-dimethylaminopropyl) carbodiimide hydrochloride and N-methyldiethanolamine with a molar ratio being 1:1 are reacted at 82° C. for 2.5 hours. Then, acetic acid with a mole number being the same as that of the used N-methyldiethanolamine is added, cationization is carried out at 55° C. for 1 hour, and the cationic modification agent of Example 9 is obtained.

Scouring Treatment and Modification Treatment

Firstly, 100% pure cotton textile fabric (composed of yarns with a specification of 32S/1) is placed in a liquid containing 6 g/L of 30% hydrogen peroxide, 5 g/L of 45% sodium hydroxide and 2 g/L of an anionic interfacial agent and with a liquor ratio of 1:10. Then, the 100% cotton textile fabric is scoured at 80° C. for 30 minutes and then cleaned with clear water. Afterwards, the cationic modification agent of Example 9 is added into water to form a solution with a concentration of 5% owf, and a pH value of the solution is adjusted to be about 12.2. Then, after being modified for 30 minutes under the conditions that a liquor ratio is 1:10 and a temperature is 55° C., the 100% cotton textile fabric is cleaned with clear water and dried at 50° C. to obtain a cationized fiber material of Example 9.

Dyeing Process

Firstly, carminic acid from a cochineal extract is added into water to form a dye solution with a concentration of 5% owf, and a pH value of the dye solution is adjusted to be 4. Then, the cationized fiber material of Example 9 is immersed in the dye solution to be dyed for 60 minutes under the conditions that a liquor ratio is 1:10 and a temperature is 80° C., and the cationized fiber material is cleaned with clear water and dried at 50° C. to obtain a colored cationized fiber material of Example 9. Afterwards, the colored cationized fiber material of Example 9 is subjected to soaping for 10 minutes with 1 g/L of the anionic interfacial agent under the conditions that a liquor ratio is 1:10 and a temperature is 98° C., and then cleaned with clear water and dried at 50° C.

Example 10

Preparation of Cationic Modification Agent

Firstly, 1-ethyl-3-(3-dimethylaminopropyl) carbodiimide hydrochloride and N-methyldiethanolamine with a molar ratio being 1:1 are reacted at 82° C. for 2.5 hours. Then, acetic acid with a mole number being the same as that of the used N-methyldiethanolamine is added, cationization is carried out at 55° C. for 1 hour, and the cationic modification agent of Example 10 is obtained.

Scouring Treatment and Modification Treatment

Firstly, 100% silk textile fabric (composed of yarns with a specification of 20S/1) is placed in a liquid containing 6 g/L of 30% hydrogen peroxide, 5 g/L of 45% sodium hydroxide and 2 g/L of an anionic interfacial agent and with a liquor ratio of 1:10. Then, the 100% silk textile fabric is scoured at 80° C. for 30 minutes and then cleaned with clear water. Afterwards, the cationic modification agent of Example 10 is added into water to form a solution with a concentration of 5% owf, and a pH value of the solution is adjusted to be about 12.2. Then, after being modified for 30 minutes under the conditions that a liquor ratio is 1:10 and a temperature is 55° C., the 100% silk textile fabric is cleaned with clear water and dried at 50° C. to obtain a cationized fiber material of Example 10.

Dyeing Process

Firstly, an extract of *Tagetes erecta* is added into water to form a dye solution with a concentration of 5% owf, and a pH value of the dye solution is adjusted to be 4. Then, the cationized fiber material of Example 10 is immersed in the dye solution to be dyed for 60 minutes under the conditions that a liquor ratio is 1:10 and a temperature is 80° C., and the cationized fiber material is cleaned with clear water and dried at 50° C. to obtain a colored cationized fiber material of Example 10. Afterwards, the colored cationized fiber material of Example 10 is subjected to soaping for 30 minutes with 2 g/L of the anionic interfacial agent under the conditions that a liquor ratio is 1:10 and a temperature is 65° C., and then cleaned with clear water and dried at 50° C.

Example 11

Preparation of Cationic Modification Agent

Firstly, 1-ethyl-3-(3-dimethylaminopropyl) carbodiimide hydrochloride and N-methyldiethanolamine with a molar ratio being 1:1 are reacted at 82° C. for 2.5 hours. Then, acetic acid with a mole number being the same as that of the used N-methyldiethanolamine is added, cationization is carried out at 55° C. for 1 hour, and the cationic modification agent of Example 11 is obtained.

Scouring Treatment and Modification Treatment

Firstly, 100% silk textile fabric (composed of yarns with a specification of 20S/1) is placed in a liquid containing 6 g/L of 30% hydrogen peroxide, 5 g/L of 45% sodium hydroxide and 2 g/L of an anionic interfacial agent and with a liquor ratio of 1:10. Then, the 100% silk textile fabric is scoured at 80° C. for 30 minutes and then cleaned with clear water. Afterwards, the cationic modification agent of Example 11 is added into water to form a solution with a concentration of 5% owf, and a pH value of the solution is adjusted to be about 12.2. Then, after being modified for 30 minutes under the conditions that a liquor ratio is 1:10 and a temperature is 55° C., the 100% silk textile fabric is cleaned with clear water and dried at 50° C. to obtain a cationized fiber material of Example 11.

Dyeing Process

Firstly, carminic acid from a cochineal extract is added into water to form a dye solution with a concentration of 5% owf, and a pH value of the dye solution is adjusted to be 4. Then, the cationized fiber material of Example 11 is immersed in the dye solution to be dyed for 60 minutes under the conditions that a liquor ratio is 1:10 and a temperature is 80° C., and the cationized fiber material is cleaned with clear water and dried at 50° C. to obtain a colored cationized fiber material of Example 11. Afterwards, the colored cationized fiber material of Example 11 is subjected to soaping for 30 minutes with 2 g/L of the anionic interfacial agent under the conditions that a liquor ratio is 1:10 and a temperature is 65° C., and then cleaned with clear water and dried at 50° C.

Example 12

Preparation of Cationic Modification Agent

Firstly, pentaerythritol tris[3-(1-aziridinyl)propionate] and N-methyldiethanolamine with a molar ratio being 1:1 are reacted at 82° C. for 2.5 hours. Then, acetic acid with a mole number being the same as that of the used N-methyldiethanolamine is added, cationization is carried out at 55° C. for 1 hour, and the cationic modification agent of Example 12 is obtained.

Scouring Treatment and Modification Treatment

Firstly, 100% pure cotton textile fabric (composed of yarns with a specification of 32S/1) is placed in a liquid containing 6 g/L of 30% hydrogen peroxide, 5 g/L of 45% sodium hydroxide and 2 g/L of an anionic interfacial agent and with a liquor ratio of 1:10. Then, the 100% cotton textile fabric is scoured at 80° C. for 30 minutes and then cleaned with clear water. Afterwards, the cationic modification agent of Example 12 is added into water to form a solution with a concentration of 5% owf, and a pH value of the solution is adjusted to be about 12.2. Then, after being modified for 30 minutes under the conditions that a liquor ratio is 1:10 and a temperature is 55° C., the 100% cotton textile fabric is cleaned with clear water and dried at 50° C. to obtain a cationized fiber material of Example 12.

Dyeing Process

Firstly, an extract of *Tagetes erecta* is added into water to form a dye solution with a concentration of 5% owf, and a pH value of the dye solution is adjusted to be 10. Then, the cationized fiber material of Example 12 is immersed in the dye solution to be dyed for 60 minutes under the conditions that a liquor ratio is 1:10 and a temperature is 80° C., and the cationized fiber material is cleaned with clear water and dried at 50° C. to obtain a colored cationized fiber material of Example 12. Afterwards, the colored cationized fiber material of Example 12 is subjected to soaping for 10 minutes with 1 g/L of the anionic interfacial agent under the conditions that a liquor ratio is 1:10 and a temperature is 98° C., and then cleaned with clear water and dried at 50° C.

Example 13

Preparation of Cationic Modification Agent

Firstly, pentaerythritol tris[3-(1-aziridinyl)propionate] and N-methyldiethanolamine with a molar ratio being 1:1 are reacted at 82° C. for 2.5 hours. Then, acetic acid with a mole number being the same as that of the used N-methyldiethanolamine is added, cationization is carried out at 55° C. for 1 hour, and the cationic modification agent of Example 13 is obtained.

Scouring Treatment and Modification Treatment

Firstly, 100% pure cotton textile fabric (composed of yarns with a specification of 32S/1) is placed in a liquid containing 6 g/L of 30% hydrogen peroxide, 5 g/L of 45% sodium hydroxide and 2 g/L of an anionic interfacial agent and with a liquor ratio of 1:10. Then, the 100% cotton textile fabric is scoured at 80° C. for 30 minutes and then cleaned with clear water. Afterwards, the cationic modification agent of Example 13 is added into water to form a solution with a concentration of 5% owf, and a pH value of the solution is adjusted to be about 12.2. Then, after being modified for 30 minutes under the conditions that a liquor ratio is 1:10 and a temperature is 55° C., the 100% cotton textile fabric is cleaned with clear water and dried at 50° C. to obtain a cationized fiber material of Example 13.

Dyeing Process

Firstly, carminic acid from a cochineal extract is added into water to form a dye solution with a concentration of 5% owf, and a pH value of the dye solution is adjusted to be 4. Then, the cationized fiber material of Example 13 is immersed in the dye solution to be dyed for 60 minutes under the conditions that a liquor ratio is 1:10 and a temperature is 80° C., and the cationized fiber material is cleaned with clear water and dried at 50° C. to obtain a colored cationized fiber material of Example 13. Afterwards, the colored cationized fiber material of Example 13 is subjected to soaping for 10 minutes with 1 g/L of the anionic interfacial agent under the conditions that a liquor ratio is 1:10 and a temperature is 98° C., and then cleaned with clear water and dried at 50° C.

Example 14

Preparation of Cationic Modification Agent

Firstly, pentaerythritol tris[3-(1-aziridinyl)propionate] and N-methyldiethanolamine with a molar ratio being 1:1 are reacted at 82° C. for 2.5 hours. Then, acetic acid with a mole number being the same as that of the used N-methyldiethanolamine is added, cationization is carried out at 55° C. for 1 hour, and the cationic modification agent of Example 14 is obtained.

Scouring Treatment and Modification Treatment

Firstly, 100% silk textile fabric (composed of yarns with a specification of 20S/1) is placed in a liquid containing 6 g/L of 30% hydrogen peroxide, 5 g/L of 45% sodium hydroxide and 2 g/L of an anionic interfacial agent and with a liquor ratio of 1:10. Then, the 100% silk textile fabric is scoured at 80° C. for 30 minutes and then cleaned with clear water. Afterwards, the cationic modification agent of Example 14 is added into water to form a solution with a concentration of 5% owf, and a pH value of the solution is adjusted to be about 12.2. Then, after being modified for 30 minutes under the conditions that a liquor ratio is 1:10 and a temperature is 55° C., the 100% silk textile fabric is cleaned with clear water and dried at 50° C. to obtain a cationized fiber material of Example 14.

Dyeing Process

Firstly, an extract of *Tagetes erecta* is added into water to form a dye solution with a concentration of 5% owf, and a pH value of the dye solution is adjusted to be 4. Then, the cationized fiber material of Example 14 is immersed in the dye solution to be dyed for 60 minutes under the conditions that a liquor ratio is 1:10 and a temperature is 80° C., and the cationized fiber material is cleaned with clear water and dried at 50° C. to obtain a colored cationized fiber material of Example 14. Afterwards, the colored cationized fiber material of Example 14 is subjected to soaping for 30 minutes with 2 g/L of the anionic interfacial agent under the conditions that a liquor ratio is 1:10 and a temperature is 65° C., and then cleaned with clear water and dried at 50° C.

Example 15

Preparation of Cationic Modification Agent

Firstly, pentaerythritol tris[3-(1-aziridinyl)propionate] and N-methyldiethanolamine with a molar ratio being 1:1 are reacted at 82° C. for 2.5 hours. Then, acetic acid with a mole number being the same as that of the used N-methyldiethanolamine is added, cationization is carried out at 55° C. for 1 hour, and the cationic modification agent of Example 15 is obtained.

Scouring Treatment and Modification Treatment

Firstly, 100% silk textile fabric (composed of yarns with a specification of 20S/1) is placed in a liquid containing 6 g/L of 30% hydrogen peroxide, 5 g/L of 45% sodium hydroxide and 2 g/L of an anionic interfacial agent and with a liquor ratio of 1:10. Then, the 100% silk textile fabric is scoured at 80° C. for 30 minutes and then cleaned with clear water. Afterwards, the cationic modification agent of Example 15 is added into water to form a solution with a concentration of 5% owf, and a pH value of the solution is adjusted to be about 12.2. Then, after being modified for 30 minutes under the conditions that a liquor ratio is 1:10 and a temperature is 55° C., the 100% silk textile fabric is cleaned with clear water and dried at 50° C. to obtain a cationized fiber material of Example 15.

Dyeing Process

Firstly, carminic acid from a cochineal extract is added into water to form a dye solution with a concentration of 5% owf, and a pH value of the dye solution is adjusted to be 4. Then, the cationized fiber material of Example 15 is immersed in the dye solution to be dyed for 60 minutes under the conditions that a liquor ratio is 1:10 and a temperature is 80° C., and the cationized fiber material is cleaned with clear water and dried at 50° C. to obtain a colored cationized fiber material of Example 15. Afterwards, the colored cationized fiber material of Example 15 is subjected to soaping for 30 minutes with 2 g/L of the anionic interfacial agent under the conditions that a liquor ratio is 1:10 and a temperature is 65° C., and then cleaned with clear water and dried at 50° C.

Comparative Example 1

Non-modified 100% pure cotton textile fabric (composed of yarns with a specification of 32S/1) is used to be dyed, and besides, a scouring treatment and a dyeing process are performed under conditions the same as Example 1 to obtain a colored fiber material of Comparative Example 1, that is, the colored fiber material of Comparative Example 1 is 100% pure cotton textile fabric dyed by prodigiosin.

Comparative Example 2

Non-modified 100% pure cotton textile fabric (composed of yarns with a specification of 32S/1) is used to be dyed, and besides, a scouring treatment and a dyeing process are performed under conditions the same as Example 2 to obtain a colored fiber material of Comparative Example 2, that is, the colored fiber material of Comparative Example 2 is 100% pure cotton textile fabric dyed by an extract of *Tagetes erecta.*

Comparative Example 3

Non-modified 100% pure cotton textile fabric (composed of yarns with a specification of 32S/1) is used to be dyed, and besides, a scouring treatment and a dyeing process are performed under conditions the same as Example 3 to obtain a colored fiber material of Comparative Example 3, that is, the colored fiber material of Comparative Example 3 is 100% pure cotton textile fabric dyed by catechin.

Comparative Example 4

Non-modified 100% pure cotton textile fabric (composed of yarns with a specification of 32S/1) is used to be dyed, and besides, a scouring treatment and a dyeing process are performed under conditions the same as Example 4 to obtain a colored fiber material of Comparative Example 4, that is, the colored fiber material of Comparative Example 4 is 100% pure cotton textile fabric dyed by melanin.

Comparative Example 5

Non-modified 100% pure cotton textile fabric (composed of yarns with a specification of 32S/1) is used to be dyed, and besides, a scouring treatment and a dyeing process are performed under conditions the same as Example 5 to obtain a colored fiber material of Comparative Example 5, that is, the colored fiber material of Comparative Example 5 is 100% pure cotton textile fabric dyed by carminic acid.

Comparative Example 6

Non-modified 100% silk textile fabric (composed of yarns with a specification of 20S/1) is used to be dyed, and besides, a scouring treatment and a dyeing process are performed under conditions the same as Example 6 to obtain a colored fiber material of Comparative Example 6, that is, the colored fiber material of Comparative Example 6 is 100% silk textile fabric dyed by an extract of *Tagetes erecta.*

Comparative Example 7

Non-modified 100% silk textile fabric (composed of yarns with a specification of 20S/1) is used to be dyed, and besides, a scouring treatment and a dyeing process are performed under conditions the same as Example 7 to obtain a colored fiber material of Comparative Example 7, that is, the colored fiber material of Comparative Example 7 is 100% silk textile fabric dyed by carminic acid.

After being obtained, the colored cationized fiber materials of Examples 1-15 and the colored fiber materials of Comparative Examples 1-7 are subjected to measurement of strength of colorization respectively. The above measurement items are explained as follows, and measurement results are displayed in Table 1 and Table 2.

Measurement of Strength of Colorization

The strength of colorization of the colored cationized fiber materials of Examples 1-15 and the colored fiber materials of Comparative Examples 1-7 is measured respectively by using a Datacolor 800V spectrometer under the conditions of a 26 mm pore diameter, a D65 light source and a 10-degree angle, in which the unit is K/S. A substance absorbing light is mainly dye, and the higher a concentration of the dye is, the higher the absorption strength is, and the smaller the scattering strength is. The strength of colorization is calculated through a following formula:

$$\frac{K}{S} = \frac{(1-R)^2}{2R}$$

proposed by a Kubelka-Munk theory, in which K is an absorption coefficient, S is a scattering coefficient, and R is a reflectivity of a maximum absorption wavelength. In addition, data in Table 1 and Table 2 are average values obtained after three times of measurement.

TABLE 1

| | Example 1 | Example 2 | Example 3 | Example 4 | Example 5 | Example 6 | Example 7 | Example 8 |
|---|---|---|---|---|---|---|---|---|
| Strength of colorization (K/S) | 2.9 | 5.2 | 8.3 | 7.9 | 9.5 | 3.6 | 4.7 | 4.9 |

| | | Example 9 | Example 10 | Example 11 | Example 12 | Example 13 | Example 14 | Example 15 |
|---|---|---|---|---|---|---|---|---|
| | Strength of colorization (K/S) | 9.3 | 3.3 | 4.5 | 4.7 | 9.2 | 3.5 | 4.3 |

TABLE 2

| | Comparative Example 1 | Comparative Example 2 | Comparative Example 3 | Comparative Example 4 | Comparative Example 5 | Comparative Example 6 | Comparative Example 7 |
|---|---|---|---|---|---|---|---|
| Strength of colorization (K/S) | 1.8 | 1.9 | 2.8 | 1.2 | 0.3 | 1.7 | 2.1 |

According to the above Table 1 and Table 2, compared with the colored fiber materials of Comparative Examples 1-7, the strength of colorization of the colored cationized fiber materials of Examples 1-15 is excellent. Specifically, according to Table 1 and Table 2, compared with the colored fiber material of Comparative Example 1, the strength of colorization of the colored cationized fiber material of Example 1 is improved by about 1.6 times; compared with the colored fiber material of Comparative Example 2, the strength of colorization of the colored cationized fiber material of Example 2 is improved by about 2.7 times; compared with the colored fiber material of Comparative Example 3, the strength of colorization of the colored cationized fiber material of Example 3 is improved by about 3.0 times; compared with the colored fiber material of Comparative Example 4, the strength of colorization of the colored cationized fiber material of Example 4 is improved by about 6.6 times; compared with the colored fiber material of Comparative Example 5, the strength of colorization of the colored cationized fiber material of Example 5 is improved by about 31.7 times; compared with the colored fiber material of Comparative Example 6, the strength of colorization of the colored cationized fiber material of Example 6 is improved by about 2.1 times; compared with the colored fiber material of Comparative Example 7, the strength of colorization of the colored cationized fiber material of Example 7 is improved by about 2.2 times; compared with the colored fiber material of Comparative Example 2, the strength of colorization of the colored cationized fiber material of Example 8 is improved by about 2.6 times; compared with the colored fiber material of Comparative Example 5, the strength of colorization of the colored cationized fiber material of Example 9 is improved by about 31.0 times; compared with the colored fiber material of Comparative Example 6, the strength of colorization of the colored cationized fiber material of Example 10 is improved by about 1.9 times; compared with the colored fiber material of Comparative Example 7, the strength of colorization of the colored cationized fiber material of Example 11 is improved by about 2.1 times; compared with the colored fiber material of Comparative Example 2, the strength of colorization of the colored cationized fiber material of Example 12 is improved by about 2.5 times; compared with the colored fiber material of Comparative Example 5, the strength of colorization of the colored cationized fiber material of Example 13 is improved by about 30.7 times; compared with the colored fiber material of Comparative Example 6, the strength of colorization of the colored cationized fiber material of Example 14 is improved by about 2.1 times; and compared with the colored fiber material of Comparative Example 7, the strength of colorization of the colored cationized fiber material of Example 15 is improved by about 2.0 times.

The above results prove that in the dyeing method using the bio-dye of the disclosure, before the dyeing treatment is performed by utilizing the bio-dye, the cationic modification treatment is performed on the fiber material through the cationic modification agent (obtained by the cationization of the fourth compound containing the carboxyl group with the third compound generated by the reaction of the first compound containing the X group and the second compound containing the Y group), so that the affinity of the bio-dye to the fiber material is enhanced and the improved strength of colorization is achieved.

Although the disclosure has been disclosed above with the embodiments, the embodiments are not for limiting the disclosure. Those of general knowledge in the art may make some alternations and modifications without departing from the spirit and scope of the disclosure, so the scope of protection of the disclosure should be defined by attached claims.

What is claimed is:

1. A dyeing method using bio-dye, comprising:

(a) reacting a first compound containing an X group with a second compound containing a Y group to form a third compound, wherein the X group is selected from the group consisting of an isocyanate group, a carbodiimide group, an aziridinyl group and an epoxy group, the second compound is an amine compound, the Y group is selected from the group consisting of a hydroxyl group and an amine group, and the number of the Y group in the second compound is two or more;

(b) carrying out cationization of the third compound with a fourth compound containing a carboxyl group to form a cationic modification agent;

(c) performing a cationic modification treatment on a fiber material by using the cationic modification agent to form a cationized fiber material; and (d) performing a dyeing treatment on the cationized fiber material through a dye solution containing bio-dye to color the cationized fiber material.

2. The dyeing method using bio-dye according to claim 1, wherein the number of the X group in the first compound containing the X group is two or more.

3. The dyeing method using bio-dye according to claim 1, wherein the first compound containing the X group comprises isophorone diisocyanate (IPDI), 1-ethyl-3-(3-dimethylaminopropyl) carbodiimide hydrochloride, or pentaerythritol tris[3-(1-aziridinyl)propionate].

4. The dyeing method using bio-dye according to claim 1, wherein the second compound containing the Y group comprises N-methyldiethanolanine.

5. The dyeing method using bio-dye according to claim 1, wherein the fiber material comprises animal fibers, plant fibers or combinations thereof.

6. The dyeing method using bio-dye according to claim 5, wherein the animal fibers comprise wool, silk, horse hair or combinations thereof, and the plant fibers comprise cellulose, cotton, linen, rayon or combinations thereof.

7. The dyeing method using bio-dye according to claim 1, wherein the bio-dye comprises carminic acid, an extract of *Tagetes erecta*, catechin, prodigiosin, melanin or combinations thereof.

8. The dyeing method using bio-dye according to claim 1, wherein the fourth compound containing the carboxyl group comprises lactic acid, acetic acid, acrylic acid or glycolic acid.

9. The dyeing method using bio-dye according to claim 1, wherein the reaction conditions of the step (a) are that the reaction is carried out at a temperature of 75° C. to 85° C. for 2-3 hours.

10. The dyeing method using bio-dye according to claim 1, wherein the reaction conditions of the step (b) are that the reaction is carried out at a temperature of 50° C. to 55° C. for 1-2 hours.

11. The dyeing method using bio-dye according to claim 1, wherein the reaction conditions of the step (c) are that a temperature is 50° C. to 60° C., and a pH value is 12-13.

12. The dyeing method using bio-dye according to claim 1, wherein the reaction conditions of the step (d) are that a temperature is 50° C. to 80° C., and a pH value is 3-11.

13. The dyeing method using bio-dye according to claim 1, wherein a molar ratio of the first compound containing the X group to the second compound containing the Y group in the step (a) is ranging from 1:0.5 to 1:1.5.

14. The dyeing method using bio-dye according to claim 1, wherein a molar ratio of the second compound containing the Y group in the step (a) to the fourth compound containing the carboxyl group in the step (b) is ranging from 1:0.8 to 1:1.2.

15. The dyeing method using bio-dye according to claim 1, wherein the step (c) further comprises preparing the cationic modification agent into a cationic modification agent solution, and a liquor ratio of the cationic modification agent solution to the fiber material is ranging from 1:5 to 1:20.

16. The dyeing method using bio-dye according to claim 1, wherein a liquor ratio of the dye solution containing the bio-dye in the step (d) to the cationized fiber material is ranging from 1:5 to 1:20.

17. A cationic modification agent, comprising:

an amine salt containing a bivalent linking group and a Y group, wherein the bivalent linking group is selected from one of a formula (I) to a formula (IV) in the following:

Formula (I)

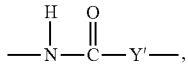

Formula (II)

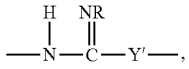

Formula (III)

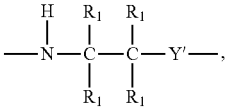

Formula (IV)

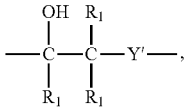

the Y group is located at one of terminals of the amine salt, and the Y group is selected from the group consisting of a hydroxyl group and an amine group, in the formula (I) to the formula (IV), each Y' is independently —NH— or —O—, in the formula (II), R is a hydrogen atom or an organic functional group with a carbon number of 1-12, and in the formula (III) and the formula (IV), each $R_1$ is independently a hydrogen atom or an organic functional group with a carbon number of 1-12.

18. The cationic modification agent according to claim 17, wherein the amine salt further contains an X group located at another terminal, and the X group is selected from the group consisting of an isocyanate group, a carbodiimide group, an aziridinyl group and an epoxy group.

* * * * *